United States Patent [19]

Daniels

[11] Patent Number: 4,743,810

[45] Date of Patent: May 10, 1988

[54] CIRCUIT ARRANGEMENT FOR OPERATING A HIGH-PRESSURE DISCHARGE LAMP

[75] Inventor: Johny A. J. Daniels, Eindhoven, Netherlands

[73] Assignee: U.S. Philips Corporation, New York, N.Y.

[21] Appl. No.: 793,527

[22] Filed: Oct. 31, 1985

[30] Foreign Application Priority Data

Nov. 6, 1984 [NL] Netherlands ..... 8403365

[51] Int. Cl.[4] ..... H05B 41/36; H05B 41/22

[52] U.S. Cl. ..... 315/221; 315/208; 315/276; 315/60

[58] Field of Search ..... 315/209 R, 72, 186, 315/289, 290, 208, 221, DIG. 7

[56] References Cited

U.S. PATENT DOCUMENTS

| | | | |
|---|---|---|---|
| 3,476,977 | 11/1969 | Hallay | 315/289 |
| 4,151,445 | 4/1979 | Davenport et al. | 315/92 |
| 4,276,496 | 6/1981 | Arena-Ochoa | 315/209 R |
| 4,342,948 | 8/1982 | Samuels | 315/289 |
| 4,370,601 | 1/1983 | Horii et al. | 315/DIG. 7 |
| 4,438,372 | 3/1984 | Zuchtriegel | 315/224 |

*Primary Examiner*—David K. Moore
*Assistant Examiner*—Theodore Salindong
*Attorney, Agent, or Firm*—Bernard Franzblau

[57] ABSTRACT

A matching circuit arrangement for operating a high-pressure discharge lamp. The circuit arrangement is provided with first and second input terminals for connection to a supply source, each of which is connected to a respective first and second output terminal. The output terminals are intended for connection of the high-pressure discharge lamp. A first controlled semiconductor switching element A having a thyristor characteristic is included in a connection between the second input terminal and the respective second output terminal. A control electrode of the switching element A is connected to a main electrode BE2 of a second controlled semiconductor switching element B having a thyristor characteristics. The main electrode AE2 of the first switching element is connected together with the main electrode BE1 of the second switching element to the second input terminal. The main electrode AE1 of the first switching element is connected to the second output terminal. The control electrode BS of the second switch is connected to a voltage divider circuit connected between the input terminals. During operation of the lamp, the lamp current will flow substantially solely via the first switching element so that the housing thereof can directly contact the input terminal, to provide a satisfactory cooling.

10 Claims, 1 Drawing Sheet

CIRCUIT ARRANGEMENT FOR OPERATING A HIGH-PRESSURE DISCHARGE LAMP

BACKGROUND OF THE INVENTION

This invention relates to a matching circuit arrangement for operating a high-pressure discharge lamp. This circuit arrangement is provided with two input terminals for connection to a supply source, each of these input terminals being connected to a respective output terminal, which output terminals are intended to connect the high-pressure discharge lamp. A controlled semiconductor switching element A having a thyristor characteristic is included in at least one connection between an input terminal and the respective output terminal in such a manner that a main electrode AE1 of the switching element A is electrically connected to the output terminal and a main electrode AE2 is connected to the input terminal, while switching element A is provided with a control electrode AS, whose control signal depends upon the voltage variation across a voltage divider circuit coupled between the two input terminals. The invention further relates to a lamp provided with such a matching circuit arrangement.

A circuit arrangement of the kind mentioned in the preceding paragraph is known from U.S. Pat. No. 4,342,948. Such a matching circuit permits a high-pressure discharge lamp to be operated in an apparatus which is provided with a stabilization ballast not adapted to the relevant lamp. Besides an increasing improvement with respect to luminous efficacy of high-pressure discharge lamps, while maintaining a desired illumination intensity, inter alia a saving of energy can thus be obtained in an existing apparatus.

In the known circuit arrangement, the control signal flows in the switching element A between the control electrode AS and the main electrode AE2, which is connected to the input terminal of the matching circuit. Controlled semiconductor switching elements having a thyristor characteristic are in practice constructed so that the metallic envelope is electrically shortcircuited with a main electrode, i.e. that main electrode across which no control signal is passed.

For the known circuit arrangement, this means that the relevant output terminal is electrically connected to the metallic envelope of the switching element A. When the matching circuit is incorporated in an equipment, for example, in a lamp base, this leads to the metallic envelope of switching element A being electrically insulated from the external input terminals for connection to a supply source present at the equipment, in this case the lamp base. As far as measures are required for cooling switching element A during operation, this has proved to be disadvantageous.

SUMMARY OF THE INVENTION

An object of the invention is to provide means by which the matching circuit is made readily usable, and cooling of switching element A, if required, is facilitated. For this purpose, according to the invention, a matching circuit arrangement of the kind mentioned in the opening paragraph is characterized in that the switching element A is controlled between the control electrode AS and the main electrode AE1 and in that AS is electrically connected to a second pole of a switch, of which a first pole is connected to the main electrode AE2 of the switching element A, while the switch is controlled by means of a signal originating from the voltage divider circuit.

The matching circuit according to the invention has the advantage that the metallic envelope of the semiconductor switching element A is electrically connected to the input terminal of the circuit arrangement. Thus, when the matching circuit is incorporated, for example, in a lamp base, the metallic envelope of switching element A can be directly metallically connected to the sleeve of the lamp base. In such a construction of the matching circuit in the lamp base, the sleeve of the lamp base acts as a cooling body for switching element A.

In an advantageous embodiment of a circuit arrangement according to the invention, the switch is constructed as a controlled semiconductor switching element B having a thyristor characteristic, a main electrode BE1 of which constitutes the first pole of the switch, a main electrode BE2 constitutes the second pole and a control electrode BS is electrically connected to the voltage divider circuit coupled between the input terminals. A switch having such a construction affords the advantage that, when the switching element A becomes conductive, the semiconductor switching element B is automatically shortcircuited, as a result of which switching element B will become non-conductive due to its thyristor characteristic.

Preferably, the connection between the control electrode AS and the second pole of the switch includes a resistor. Thus, it is achieved that under all imaginable conditions the lamp current will flow substantially entirely through the switching element A. Power dissipation, which will make measures for heat dissipation necessary, will thus occur only in switching element A.

BRIEF DESCRIPTION OF THE DRAWINGS

An embodiment of a lamp according to the invention will be described more fully with reference to the accompanying drawing.

In the drawing.

DESCRIPTION OF THE PREFERRED EMBODIMENTS

Figure 1:
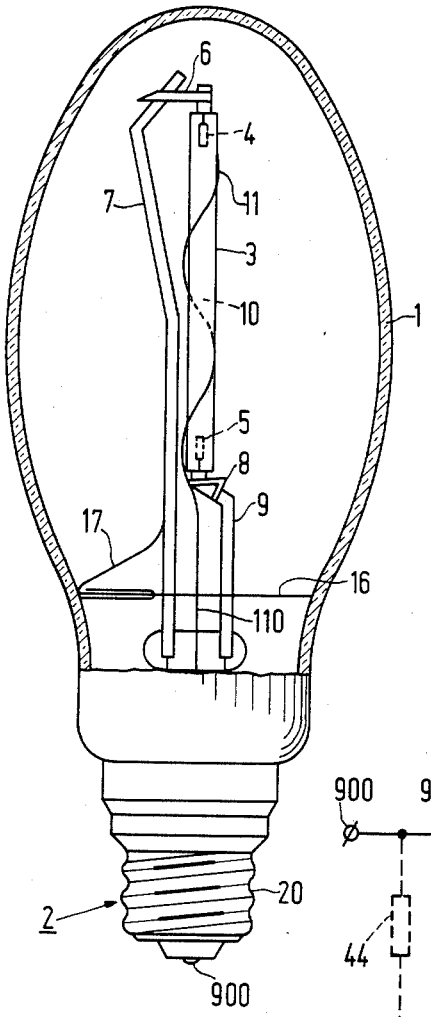
FIG. 1 is a partly developed view of a high pressure discharge lamp provided with the matching circuit arrangement.

In FIG. 1, reference numeral 1 designates an outer bulb of the lamp with lamp base 2 and sleeve 20. The outer bulb encloses a discharge vessel 3 provided with two internal discharge electrodes 4,5, between which extends a discharge path 10, and provided with an external auxiliary electrode 11. The discharge electrode 4 is connected by means of a metal strip 6 to a rigid current conductor 7. The discharge electrode 5 is connected through a metal strip 8 to a rigid current conductor 9. The internal discharge electrodes 4,5 are each connected through the rigid current conductors 7,9 to a respective input terminal, constituted by the metal sleeve 20 and a contact 900 of the lamp present in the lamp base.

The external auxiliary electrode 11 is connected through a current conductor 110 to a starting circuit, which is arranged in the lamp base and forms part of the matching circuit arrangement. There is further mounted in the outer bulb an aluminium heat shield 16 between the discharge vessel 3 and the lampbase 2. A nickel strip 17 is welded to the rigid current conductor 7 and grips around the heat shield 16, thereby clamping and thus simply and effectively positioning the said heat shield 16.

Figure 2:
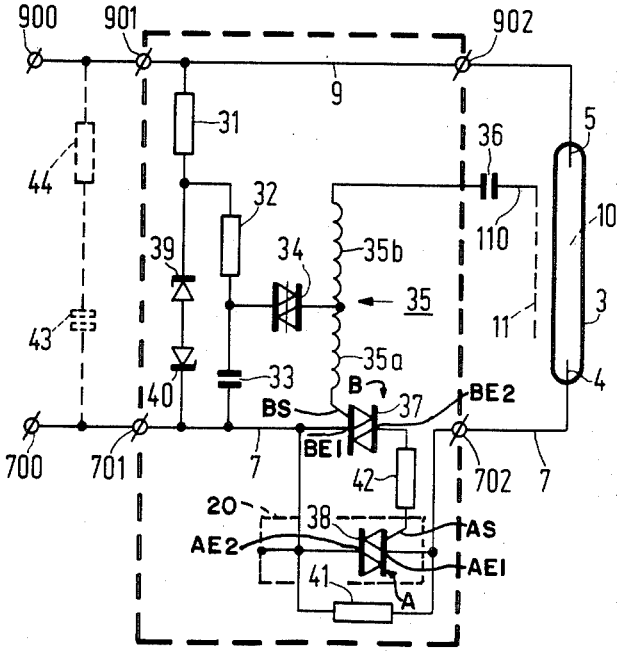
FIG. 2 shows an electric circuit diagram of the lamp provided with the matching circuit arrangement.

In FIG. 2, the part enclosed by a broken line represents the matching circuit arrangement, which is included between the input terminals 700 and 900 of the lamp and the internal discharge electrodes 4,5. Input terminals 701 and 901 of the matching circuit arrangement are directly connected to the input terminals 700 and 900 of the lamp and are each connected to a respective output terminal 702 and 902. The output terminals 702 and 902 of the matching circuit arrangement are electrically connected to the internal discharge electrodes 4,5 of the lamp. The connection between the input terminal 700 and the internal discharge electrode 4 includes a controlled semiconductor switching element A (38) having a thyristor characteristic, of which a main electrode AE1 is electrically connected to the discharge electrode 4 and a main electrode AE2 to the input terminal 700. A resistor 41 is connected in parallel across electrodes AE1 and AE2. A control electrode AS of the switching element A (38) is connected through a resistor 42 to a main electrode BE2 of a semiconductor switching element B (37). A main electrode BE1 of the switching element B (37) is connected to the main electrode AE2 of the switching element 38. A control electrode BS of the switching element 37 is connected via a primary transformer winding 35*a* of the transformer 35 and a breakdown element 34 to a voltage divider circuit coupled between the input terminals 701 and 901. The voltage divider circuit comprises a resistor 31 connected in series with two parallel branches, the first of which comprises two Zener diodes 39,40 connected in series opposition and the second of which comprises a resistor 32 and a capacitor 33. The secondary winding 35*b* of the transformer 35 is connected through a blocking capacitor 36 and the current conductor 110 to the external auxiliary electrode 11. The matching circuit in this case serves at the same time as a starting circuit.

In a modification of the lamp, the electric circuit is extended by a series arrangement of a capacitor 43 and a resistor 44, which is connected parallel to the voltage divider circuit between the input terminals 700 and 900. However, this series arrangement may also form part of the matching circuit arrangement. Alternatively, the series arrangement of the capacitor 43 and the resistor 44 may be arranged outside the lamp and separately from the matching circuit arrangement.

The breakdown element 34 is in the form of an uncontrolled voltage-dependent breakdown element having a thyristor characteristic. However, the element 34 may alternatively be constructed as a controlled switching element whose control depends upon the voltage variation across the voltage divider circuit. The position of the breakdown element 34 and the primary transformer winding 35*a* can be interchanged.

The operation of the electric circuit diagram is as follows:

When an alternating voltage is applied as a supply voltage to the input terminals 700, 900 via a stabilization ballast, the capacitor 33 is charged through the resistors 31 and 32. When the voltage at the capacitor 33 has become so high that the breakdown voltage of the breakdown element 34 is reached, the breakdown element breaks down and becomes conductive. Subsequently, the capacitor 33 is abruptly discharged through the primary transformer winding 35*a* and the switching element 37. This abrupt discharge produces a voltage pulse in the transformer 35, which is induced in the secondary transformer winding 35*b*, as a result of which a high instantaneous voltage is applied via the blocking capacitor 36 between the external auxiliary electrode 11 and the internal discharge electrodes 4,5 of the discharge vessel 3.

As soon as the current through the breakdown element 34 falls to zero, the breakdown element becomes non-conducting again, after which the process described is repeated. The high instantaneous voltage applied, due to the process described, between the external auxiliary electrode 11 and the internal discharge electrodes 4,5 will produce a discharge between the internal discharge electrodes via the discharge path 10 and will thus ignite the lamp.

The discharge current of the capacitor 33 via the control electrode BS of the switching element 37 causes the switching element to become conductive. Due to the fact that switching element B becomes conductive, in the ignited state of the lamp a current will flow via the resistor 42 through the control electrode AS of the switching element 38, which in turn becomes conductive. Subsequently, a lamp current will flow between the input terminals 700 and 900 via switching element A and via the internal discharge electrodes 4,5 and the discharge path 10. Moreover, due to the fact that switching element A becomes conductive, switching element B is shortcircuited, as a result of which the current through the switching element approaches zero and B becomes non-conductive. When the voltage across the lamp and hence the lamp current falls to zero, the switching element 38 becomes non-conductive again, after which the process described is repeated. During the non-conducting state of the switching element 38, a small ionization current can continue to flow via the resistor 41 through the discharge vessel. This promotes the re-ignition of the discharge as soon as A has been triggered into conduction.

In this configuration, the switching element A (38) therefore conveys substantially the whole lamp current and has thus to be provided with cooling means. Since in this switching element 38 the main electrode AE2 is connected to the input terminal 700 of the lamp, it is possible, when using the metal sleeve 20 of the lamp base 2 as input terminal 700, to bring the housing of switching element A into direct mechanical contact with this sleeve.

The Zener diodes 39 and 40 ensure that variations in the amplitude of the supply voltage can have very little influence on the instant of breakdown of the breakdown element 34.

In a lamp provided with the series arrangement comprising the capacitor 43 and the resistor 44, the capacitor 43 will be charged during each cycle of the alternating supply voltage. During starting of the lamp, this results in the voltage at the internal discharge electrodes 4,5 being kept substantially constant immediately after breakdown of the breakdown element 34, which is conducive to a discharge being produced in the discharge vessel 3. During operation of the lamp, that is to say after the lamp has been ignited, during re-ignition of the discharge, i.e. as soon as switching element B becomes conductive, the capacitor 43 will be discharged via the discharge path 10, which promotes a rapid re-ignition.

In the case of a practical example, the lamp was operated at an alternating voltage source of 220 V, 50 Hz, and the power consumption of the lamp was 77 W. The lamp was operated in combination with a ballast intended for operation of a 125 W high-pressure mercury vapour discharge lamp. The lamp concerned was a high-pressure sodium lamp, whose discharge vessel contained 25 mg of amalgam comprising 18% by weight of Na and 82% by weight of Hg. The discharge vessel further contained xenon at a pressure of about 10 kPa at 300 K. During operation of the lamp, the luminous flux was 6750 lm and the arc voltage between the main electrodes was 115 V. The components as shown in the electric circuit diagram of the lamp were proportioned as follows:

| | |
|---|---|
| resistor 31 | 10 kΩ |
| resistor 32 | 17 kΩ |
| resistor 41 | 10 kΩ |
| resistor 42 | 2 kΩ |
| resistor 44 | 1 kΩ |
| capacitor 33 | 47 nF |
| capacitor 36 | 2.2 nF |
| capacitor 43 | 50 nF |
| Zener diode 39 | Philips type BZT 03, |
| Zener diode 40 | breakdown voltage 180 V |
| breakdown element 34 | Shindengeng, type SIDAC K1V24, breakdown voltage 120 V |
| switching element A 38 | TRIAC, Philips, |
| switching element B 37 | type BT 139 |
| transformer 35 | number of primary windings 25<br>number of secondary windings 600<br>ferrite core. |

The housing of the switching element A was in direct metallic contact with the sleeve 20 of the lamp base 2.

For comparison it should be noted that during operation of a 125 W high-pressure mercury vapour discharge lamp with the stabilization ballast intended therefor, the luminous flux is about 6300 lm. The lamp according to the invention therefore yields in operation with a comparable luminous flux a saving in energy of about 40%.

What is claimed is:

1. A matching circuit for coupling a discharge lamp to a pair of terminals for a source of lamp supply voltage, said matching circuit comprising: first and second input terminals for connection to said pair of supply voltage terminals, first and second output terminals for connection to terminals of the lamp, a thyristor type semiconductor switching element connected in series with said output terminals across said first and second input terminals of the matching circuit such that first and second main electrodes of the switching element are electrically connected to the second output terminal and to the second input terminal, respectively, a voltage divider connected across said first and second input terminals, a controlled switch having first and second poles connected to a control electrode of the thyristor type switching element and to the second main electrode of the thyristor type switching element, respectively, whereby a control current for the thyristor type switching element will flow through a junction between the first main electrode and the control electrode thereof and via the first and second poles of the controlled switch, and means coupling a control terminal of the controlled switch to an output terminal of the voltage divider so as to control operation of the controlled switch by means of an output signal from the voltage divider, wherein said coupling means includes a voltage-breakdown element and a primary winding of a transformer having a secondary winding for coupling an ignition pulse to an auxiliary electrode of the discharge lamp.

2. A matching circuit as claimed in claim 1 adapted to couple a discharge lamp of a first type to said pair of input terminals via a lamp operating circuit designed to operate a discharge lamp of a second different type than said first type of discharge lamp, whereby said second type of lamp can be replaced by said first type of lamp in an existing lamp operating circuit without a substantial change in said lamp operating circuit.

3. A matching circuit as claimed in claim 1 wherein said thyristor type switching element comprises a metallic envelope electrically connected to the second main electrode and in physical contact with the second input terminal which is arranged to provide a substantial cooling area for heat developed in the thyristor type switching element.

4. A matching circuit as claimed in claim 3 wherein said second input terminal comprises a metallic generally cylindrical screw-in element of a base member of a screw-in type discharge lamp.

5. A matching circuit as claimed in claim 1 further comprising a resistor connected between the first pole of the controlled switch and the control electrode of the thyristor type switching element and with a resistance value such that substantially all lamp current will flow through the thyristor type switching element and practically none will flow through the controlled switch.

6. A matching circuit as claimed in claim 1 wherein the controlled switch comprises a second thyristor type semiconductor switching element and the first and second thyristor type switching elements are connected in circuit so that when the first thyristor type switching element is conductive it substantially short-circuits the second thyristor type switching element which thus becomes non-conductive.

7. A matching circuit as claimed in claim 1, further comprising a resistor connected between the control electrode of the switching element and the first pole of the switch.

8. A high-pressure discharge lamp comprising a pair of input terminals for connection to an external source of supply voltage, a discharge vessel provided with two internal discharge electrodes between which a discharge path extends, each internal discharge electrode in the lamp being electrically connected to a respective input terminal of the lamp, and a matching circuit as claimed in claim 1 coupled between said input terminals and said internal discharge electrodes.

9. A matching circuit as claimed in claim 1 wherein said semiconductor switching element includes a metallic envelope for housing same and wherein said metallic envelope is electrically short-circuited to said second main electrode which comprises a power electrode of the thyristor type switching element, said second main electrode being directly connected to the second input terminal which comprises a metallic element with a substantial area for providing a heat sink function for said thyristor type switching element.

10. A matching circuit as claimed in claim 1 further comprising a resistor connected in shunt with the semiconductor switching element and having a resistance value so as to allow a small ionization current to flow through the lamp via said resistor when the first switching element is in a cut-off state.

* * * * *